US007104589B2

(12) United States Patent
Takeda et al.

(10) Patent No.: US 7,104,589 B2
(45) Date of Patent: Sep. 12, 2006

(54) DOOR DRIVING UNIT

(75) Inventors: Nobuhiko Takeda, Aichi-ken (JP); Bunshi Ohta, Okazaki (JP); Yasutaka Shinoda, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 288 days.

(21) Appl. No.: 10/705,878

(22) Filed: Nov. 13, 2003

(65) Prior Publication Data

US 2004/0139656 A1 Jul. 22, 2004

(30) Foreign Application Priority Data

Nov. 14, 2002 (JP) ..... 2002-331021

(51) Int. Cl.
*E05F 11/24* (2006.01)
*E05F 15/10* (2006.01)

(52) U.S. Cl. ..... 296/146.8; 49/340; 49/341; 49/342; 74/89

(58) Field of Classification Search ..... 49/340, 49/341, 342; 296/146.4, 146.8; 74/89, 89.16
See application file for complete search history.

(56) References Cited

U.S. PATENT DOCUMENTS 2,930,434 A * 3/1960 Elov ..... 160/188
3,713,472 A * 1/1973 Dozois ..... 160/189
3,886,425 A * 5/1975 Weiss ..... 318/468
5,588,258 A * 12/1996 Wright et al. ..... 49/340
5,752,344 A * 5/1998 Richmond ..... 49/340
6,234,563 B1 * 5/2001 Bascou ..... 296/146.8
6,676,190 B1 * 1/2004 Daniels et al. ..... 296/106
2003/0085589 A1 * 5/2003 Oberheide ..... 296/146.8

FOREIGN PATENT DOCUMENTS

JP 2000-96913 A 4/2000

* cited by examiner

*Primary Examiner*—Gregory J. Strimbu
(74) *Attorney, Agent, or Firm*—Buchanan Ingersoll & Rooney PC

(57) ABSTRACT

A door driving unit includes a driving mechanism rotatable in a reciprocating manner within a predetermined operational angle range, a body portion fixed to a vehicle body, a first member driven by the driving mechanism, and a second member driven by the first member by being in contact with the first member. The first member and the second member are supported by a common shaft. The door driving unit further includes an engaging mechanism for engaging the first member and the second member with each other so that the first member and the second member rotate as a unit with each other within a first predetermined angle range when the first member drives to rotate the second member.

6 Claims, 9 Drawing Sheets

FIG. 5A
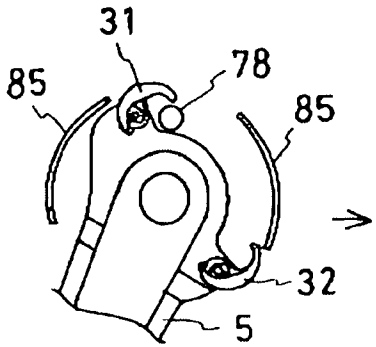
Fully closed state
FIG. 5B
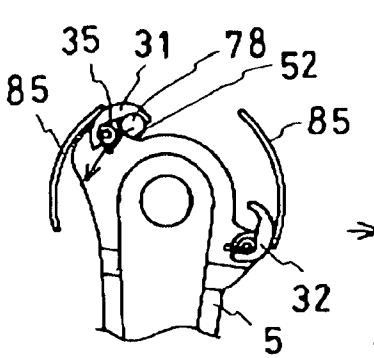
Opening operation
FIG. 5C
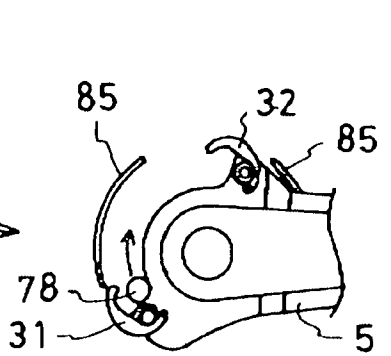
Opening completed: Driving pin starts returning
FIG. 5D
Fully open state
FIG. 5E
Closing operation
FIG. 5F
Closing completed: Driving pin starts returning

DOOR DRIVING UNIT

This application is based on and claims priority under 35 U.S.C. § 119 with respect to Japanese Application No. 2002-331021 filed on Nov. 14, 2002, the entire content of which is incorporated herein by reference.

FIELD OF THE INVENTION

This invention generally relates to a driving unit. More particularly, the present invention pertains to a driving unit for opening and closing a vehicle door pivotally supported on a vehicle.

BACKGROUND OF THE INVENTION

A known driving unit is employed for opening or closing a back door of a vehicle. Such driving unit is disclosed in Japanese Patent Laid-Open Publication No. 2000-96913. According to the disclosed driving unit, an end portion of a back door is pivotally supported on a vehicle body via a supporting shaft. The back door can be then open or closed by means of the driving unit including an electric motor. This type of back door can be open or closed manually as required. The driving unit includes a driving pin rotatable in reciprocating manner by means of the electric motor and operates the back door in opening or closing direction thereof by contacting the driving pin with a driving arm connected to the back door. According to the aforementioned structure, the driving pin returns to a predetermined position whenever the opening or closing operation of the back door is completed so that the back door can be open or closed manually. Thus, the driving arm is rotatable without being restrained by the driving pin. The back door having the aforementioned structure is maintained at a fully open position thereof by means of a gas stay.

According to the disclosed driving unit, the driving pin is in contact with the driving arm so as to open or close the back door. Therefore, for example, the back door is closed by the operation of the driving unit within a range specified with a solid line shown in FIG. 9A during the closing operation. However, the back door is closed by the operation of the gas stay within a range specified with a dashed line in FIG. 9A. Even if an obstacle such as A in FIG. 9A is pinched between the back door and the vehicle body, the back door cannot be stopped by the operation of the driving unit. In the same way, the back door cannot be stopped within the range specified with the dashed line in FIG. 9B during the opening operation.

Thus, a need exists for a driving unit that can stop or reverse the back door by means of the operation of the driving unit during the opening or closing operation of the back door.

SUMMARY OF THE INVENTION

According to an aspect of the present invention, a door driving unit includes a driving mechanism rotatable in a reciprocating manner within a predetermined operational angle range, a body portion fixed to a vehicle body, a first member driven by the driving mechanism, and a second member driven by the first member by being in contact with the first member. The first member and the second member are supported by a common shaft. The door driving unit further includes an engaging mechanism for engaging the first member and the second member with each other so that the first member and the second member rotate as a unit with each other within a first predetermined angle range when the first member drives to rotate the second member.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein:

FIG. 5A is a view for explaining an operation of the driving unit according to the fully closed state of the back door of the present invention;

FIG. 5B is a view for explaining an operation of the driving unit according to the opening operation state of the back door of the present invention;

FIG. 5C is a view for explaining an operation of the driving unit according to a completed opening state of the back door of the present invention;

FIG. 5D is a view for explaining an operation of the driving unit according to the fully opened state of the back door of the present invention;

FIG. 5E is a view for explaining an operation of the driving unit according to the closing operation state of the back door of the present invention;

FIG. 5F is a view for explaining an operation of the driving unit according to completed closing state of the back door of the present invention;

DETAILED DESCRIPTION OF THE INVENTION

An embodiment of the present invention is explained referring to FIGS. 1 to 9.

Figure 1:
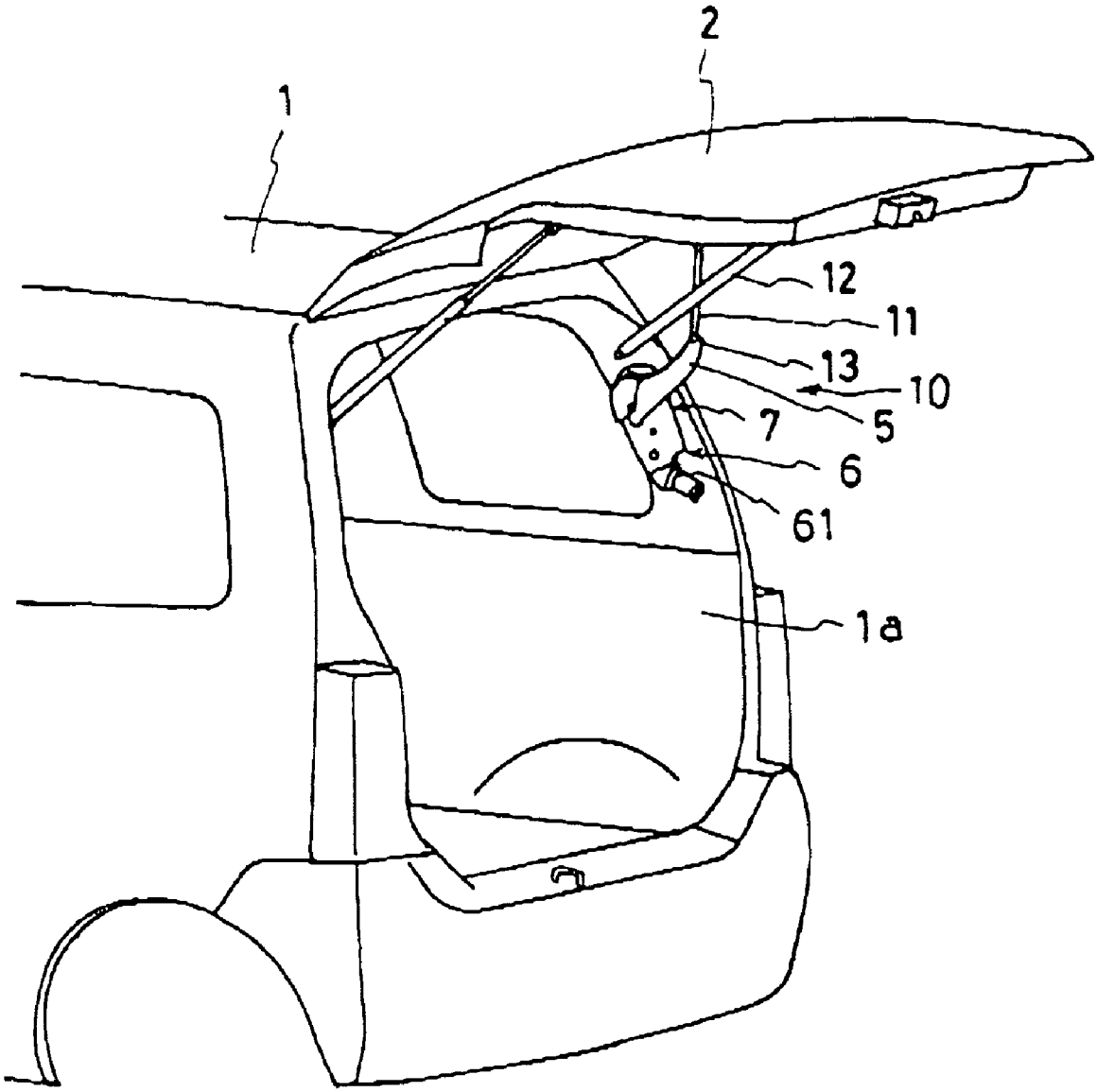
FIG. 1 is a perspective view of a vehicle and a back door with which a driving unit according to an embodiment of the present invention is equipped.
Figure 2:
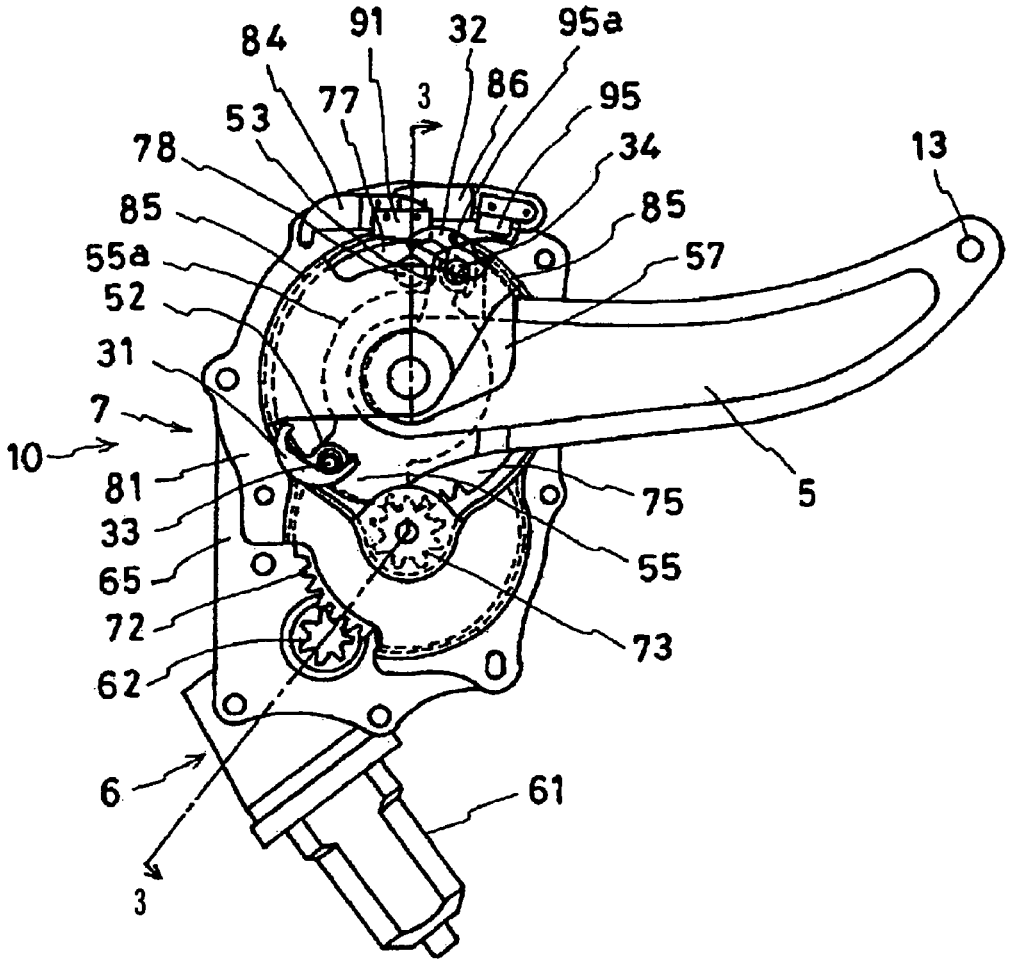
FIG. 2 is a side view of the driving unit according to the embodiment of the present invention.

As shown in FIGS. 1 and 2, a driving unit 10 includes a driving portion 6 and a body portion 7, which is fixed to a vehicle body 1. The driving portion 6 includes an electrical motor 61. A driving arm 5 (rotated member) extends from the body portion 7 and whose tip portion is provided with a joint 13. The driving unit 10 is connected to a back door 2 via a connecting link 11 by means of the joint 13. The back door 2 opens or closes an opening portion 1*a* by the driving arm 5*a* swinging in upward and downward direction in FIG. 1.

In addition, the driving unit 10 according to the present embodiment is equipped with a gas stay 12 for applying a biasing force to the back door 2 in the same way as the known back door in order to maintain the back door 2 at a fully open position or a fully closed position.

Figure 3:
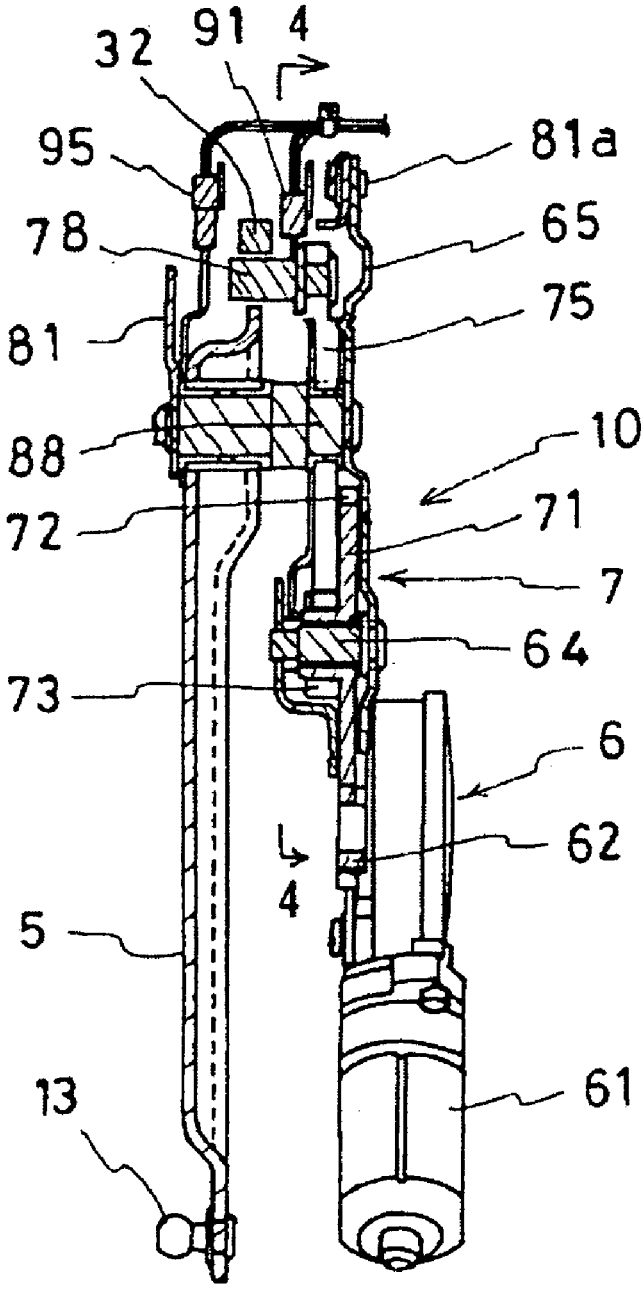
FIG. 3 is a cross-sectional view taken along a line 3—3 of FIG. 2.

A structure of the driving unit 10 is explained referring to FIGS. 2 and 3.

The driving unit 10 includes a first case 65 and a second case 81 constituting the body portion 7 and assembled to each other via a plurality of screws 81*a*. A clearance is defined between the first case 65 and the second case 81 and in which two shafts 64 and 88 are arranged, crossing between the first case 65 and the second case 81. A driving gear 71 is rotatably supported on the shaft 64 while an output gear 75 is rotatably supported on the shaft 88.

The driving gear 71 is integrally formed with a large gear portion 72 and a small gear portion 73. The small gear portion 73 engages with the output gear 75 while the large gear portion 72 engages with a driving pinion 62 of the driving portion 6. The rotation of the electric motor 61 is therefore decelerated and transmitted to the output gear 75. A driving pin 78 (contacting portion) is assembled on a side face of the output gear 75, projecting therefrom at right angles (i.e. in horizontal direction in FIG. 3).

The elongated driving arm 5 is made of plate material and rotatably supported on the shaft 88 at one end. A flange portion 55 is formed at an outer peripheral portion on the one end side of the driving arm 5. An arc portion 55*a* is formed at an edge portion of the flange portion 55 along a predetermined angle range with respect to the shaft 88. In addition, shoulder portions 52 and 53 are formed at respective ends of the arc portion 55*a*, extending in radial direction thereof. The driving pin 78 rotates relative to the driving arm 5 within a predetermined angle specified between the shoulder portions 52 and 53. The rotation of the output gear 75 is transmitted to the driving arm 5 by the driving pin 78 in contact with one of the shoulder portions 52 and 53.

As shown in FIG. 2, hooks 31 and 32 are rotatably assembled via the shafts 33 and 34 respectively to the respective flange portions 55 provided at the shoulder portions 52 and 53. In addition, springs 35 and 36 (shown in FIG. 4) are assembled to the shafts 33 and 34 respectively. Each first end of the spring 35 or 36 engages with each flange portion 55 provided at the shoulder portion 52 or 53 while each second end of the spring 35 or 36 engages with each hook 31 or 32 for biasing the hook 31 or 32 to rotate in a predetermined direction.

Figure 4:
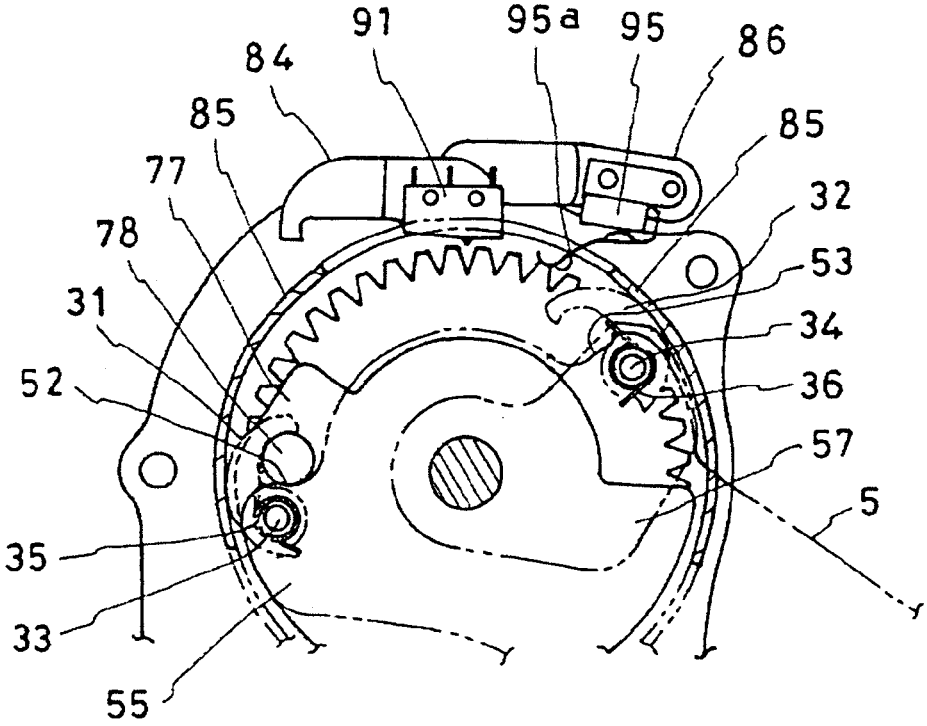
FIG. 4 is a cross-sectional view taken along a line 4—4 of FIG. 3.

As shown in FIGS. 2 and 4, the second case 81 is formed with two arc walls (contacting wall) 85 partially surrounding the hooks 31 and 32 respectively from an outside, i.e. radially outer side, with respect to the shaft 88 within each predetermined angle range. The driving pin 78 becomes in contact with one of the shoulder portions 52 and 53, thereby rotating the driving arm 5. Then, the hook 31 or the hook 32 enters inside, i.e. radially inward side, of the arc wall 85. A backside, i.e. radially outer side with respect to the shaft 88, of the hook 31 or the hook 32 becomes in contact with an inner side of the arc wall 85. The hook 31 or the hook 32 is pushed by the arc wall 85 and rotates, holding the driving pin 78 against the biasing force of the spring 35 or 36. The driving arm 5 and the output gear 75 engage with each other and rotate as a unit accordingly. Each arc wall 85 is formed in a range where the hook 31 or the hook 32 rotates to move when the back door 2 opens or closes. When the driving arm 5 is arranged at the highest position or the lowest position thereof, the hook 31 or the hook 32 is not positioned inside of each arc wall 85 and thus the engagement between the hook 31 or 32 and each arc wall 85 is released.

The driving unit 10 also includes a plurality of operation position detecting means for detecting a status of the driving unit 10 as shown in FIGS. 2, 3 and 4 in order to control the operation of the back door 2 (to be mentioned later).

A first operation position detecting means includes a cam plate 77 fixed to the output gear 75 and a neutral position detecting switch 91 assembled to the second case 81 via a bracket 84 for detecting the position of the driving pin 78. The cam plate 77 is arranged to switch the neutral position detecting switch 91 between ON status and OFF status when the driving pin 78 reaches the highest position as shown in FIG. 2. That is, the neutral position detecting switch is switched to OFF status from ON status when the driving pin 78 rotates in the counterclockwise direction from a first side to a second side of FIG. 2 relative to the highest position and then maintained in OFF status. On the other hand, the neutral position detecting switch 91 is switched to ON status from OFF status when the driving pin 78 rotates in the clockwise direction from the second side to the first side of FIG. 2 relative to the highest position and then maintained in ON status.

Further, a second position detecting means includes a cam plate 57 assembled to the driving arm 5 and a full-open position detecting switch 95 assembled to the second case 81 via a bracket 86 for detecting the position of the driving arm 5. When the driving arm 5 rotates in upward direction in FIG. 2 and the back door 2 reaches a position slightly before the fully open position thereof, the cam plate 57 pushes an operation lever 95*a* of the full-open position detecting switch 95 and brings the full-open position detecting switch 95 to turn to ON status.

Other position detecting means include a full-close detecting switch (not shown) for detecting a status of the back door 2 closing the opening portion 1*a* of the vehicle body 1. A known courtesy switch is generally employed for the full-close detecting switch.

Figure 6:
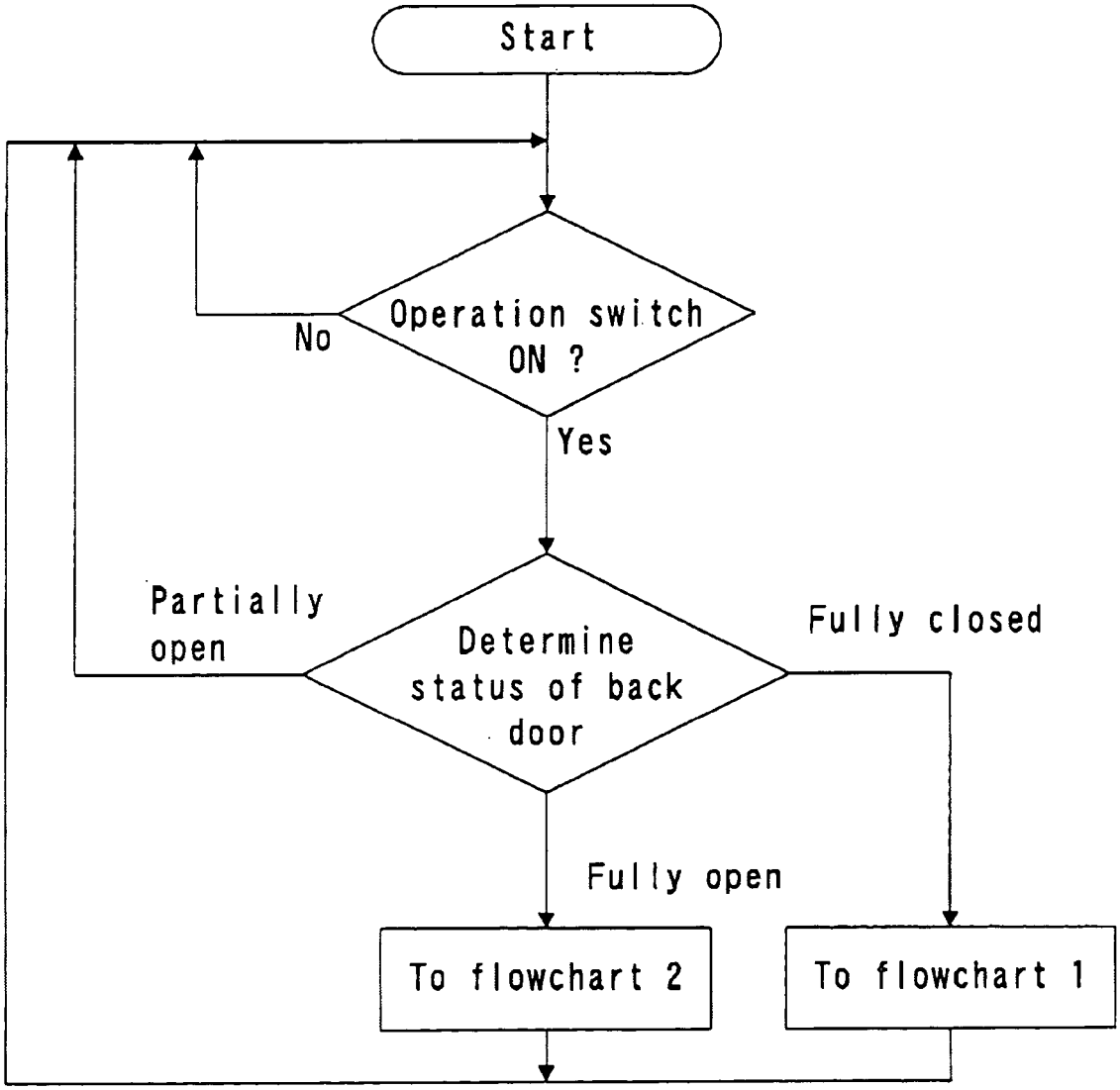
FIG. 6 is a flowchart of a basic operation of the driving unit according to the embodiment of the present invention.
Figure 7:
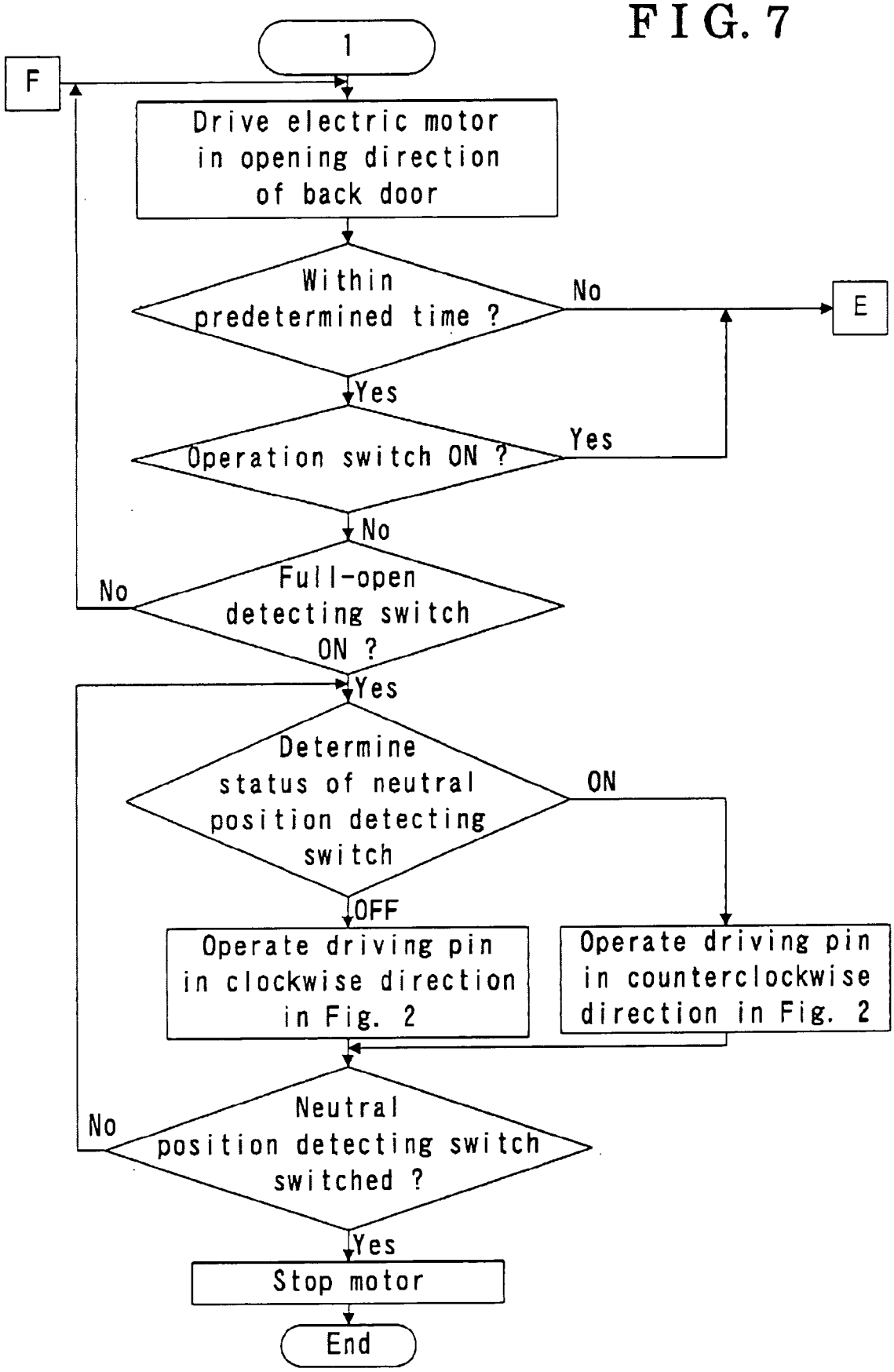
FIG. 7 is a flowchart of an opening operation of the back door performed by the driving unit according to the embodiment of the present invention.
Figure 8:
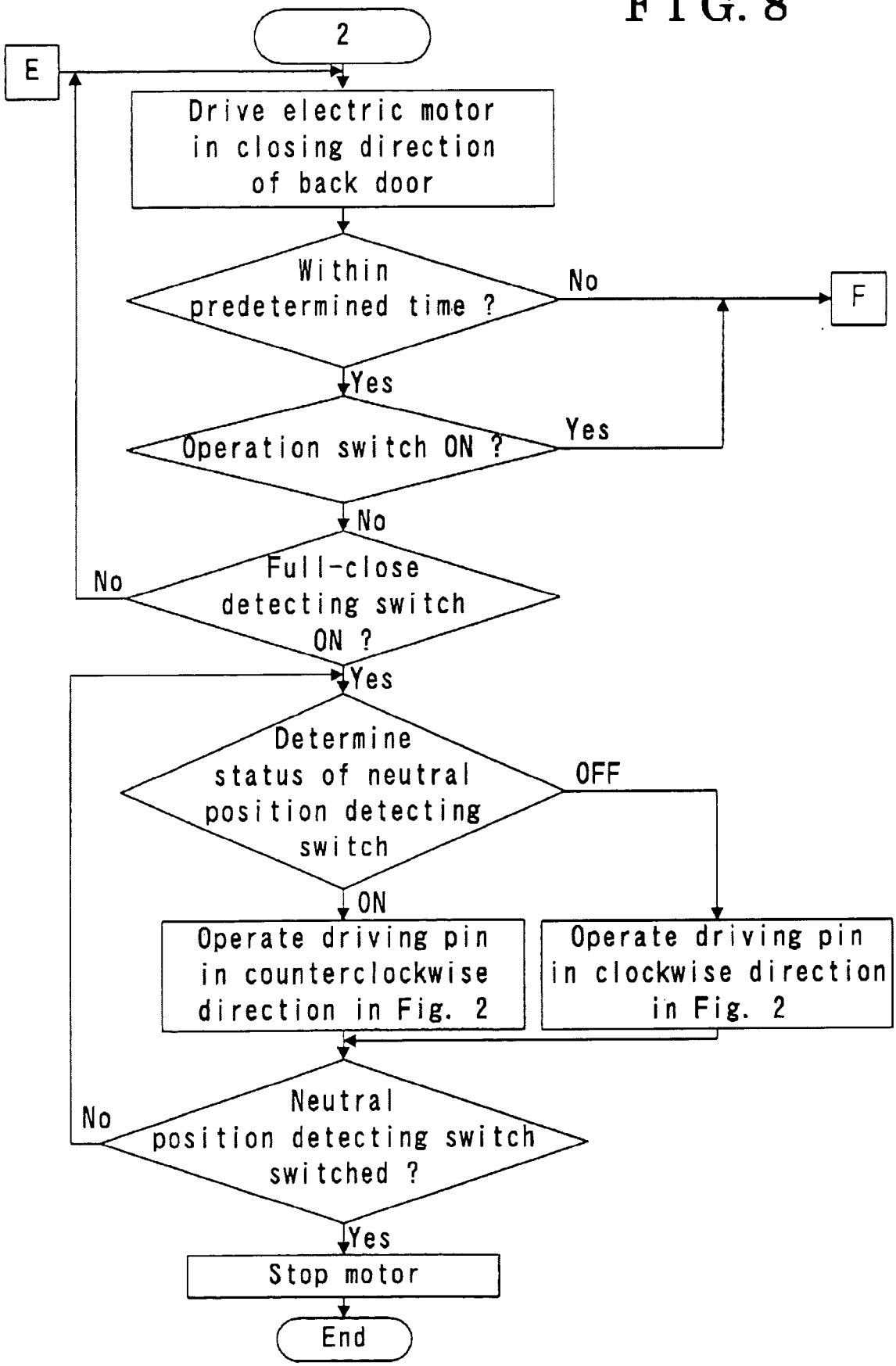
FIG. 8 is a flowchart of a closing operation of the back door performed by the driving unit according to the embodiment of the present invention.

An operation of thus-structured driving unit 10 is explained referring to FIGS. 1, 2, 4 and 5 and flowcharts shown in FIGS. 6 to 8.

A control unit (not shown) constantly monitors each status of an operation switch (not shown) for operating the back door 2, the full-close detecting switch and the full-open position detecting switch 95 as shown in a basic operation flowchart of FIG. 6. When the operation switch is turned to ON status, i.e. when it is recognized that the operation switch is manipulated through a one-touch operation, the process proceeds to the determination of a status of the back door 2. If the back door 2 is detected to be fully closed by the full-close detecting switch, the process proceeds to the operation for opening the back door 2 as shown in the flowchart 1 of FIG. 7. If the back door 2 is detected to be fully open since the full-open detecting switch is turned to ON status, the process proceeds to the operation for closing the back door 2 as shown in the flowchart 2 of FIG. 8. In addition, if neither full-closed status nor the full-open status of the back door 2 is recognized, it is determined that an operator opens or closes the back door 2 manually and thus the back door 2 is partly open. Then the driving unit 10 does not initiate to open or close the back door 2.

The driving unit 10 according to the present embodiment is constituted so as to be able to open or close the back door 2 through the one-touch operation, i.e. by only one depression of single operation switch (not shown).

An opening operation of the back door 2 is explained referring to the flowchart 1 of FIG. 7. According to the flowchart, the electric motor 61 drives the output gear 75 so that the back door 2 opens, i.e. moves in the counter clockwise direction of FIG. 1. The driving pin 78 becomes in contact with the shoulder portion 52 of the driving arm 5 as shown in FIG. 5A and rotates the driving arm 5 in the counterclockwise direction from a fully closed state shown in FIG. 5A. An end portion of the driving arm 5 is raised, thereby opening the back door 2 via the connecting link 11. Further, as shown in FIG. 5B, the back face of the hook 31 is pushed by the arc wall 85 along with the rotation of the driving pin 78, thereby rotating the hook 31 against the biasing force of the spring 35. The hook 31 holds the driving pin 78 whereby the driving arm 5 and the output gear 75 rotate as a unit with each other. Then, the opening operation of the back door 2 proceeds further due to the rotation of the driving pin 78. Unless the back door 2 contacts with an obstacle that prevents the opening of the back door 2 during the opening operation thereof or the operator presses the operation switch with the intention of stopping the opening operation of the back door 2, the back door 2 opens automatically up to the fully open position thereof.

When the driving pin 78 reaches the vicinity of the lowest position thereof as shown in FIG. 5C, the driving arm 5 rotates in the upward direction and then the full-open position detecting switch 95 is switched to ON status. At this time, the hook 31 is released from the arc wall 85 and also the driving pin 78. The back door 2 is completely raised to and maintained at the fully open position by the operation of the gas stay 12. Meanwhile, the cam plate 77 rotates in the counter clockwise direction in FIG. 4 and thus the neutral position detecting switch 91 is in OFF status. When the OFF status of the neutral position detecting switch 91 is recognized, only the driving pin 78 reverses in the clockwise direction as shown in FIGS. 5C and 5D, returning to the neutral position, i.e. the highest position. When it is detected that the driving pin 78 returns to the neutral position and the neutral position detecting switch 91 is switched to ON status from OFF status, the electric motor 61 stops driving to thereby complete the opening operation of the back door 2.

Next, the closing operation of the back door 2 is explained according to the flowchart 2 of FIG. 8. The process of the flowchart 2 is similar to that of the flowchart 1. That is, the driving pin 78 rotates in the clockwise direction from a state shown in FIG. 5D and finally returns to the neutral position. The closing operation of the back door 2 is completed when the driving pin 78 becomes a state shown in FIG. 5A. At this time, the electric motor 61 stops driving when it is detected that the neutral position detecting switch is turned to OFF status from ON status to thereby complete the closing operation of the back door 2.

Figure 9A:
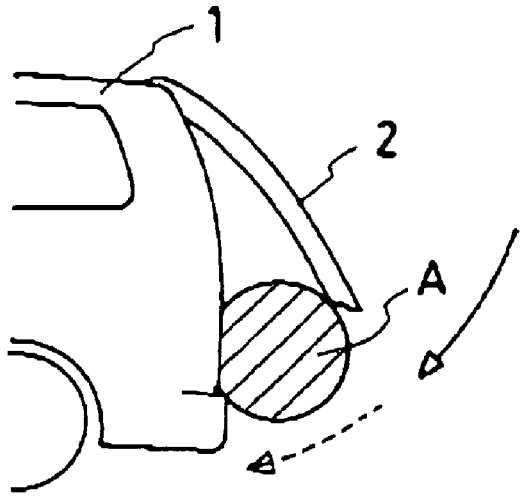
FIG. 9A is a view for explaining a status hitting an obstacle at the inside of the back door.
Figure 9B:
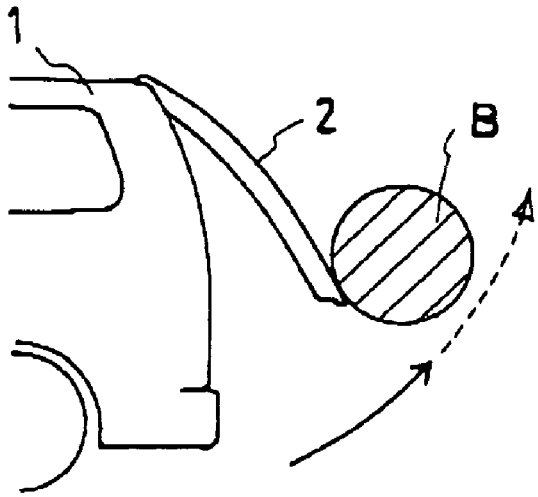
FIG. 9B is a view for explaining a status hitting an obstacle at the outside of the back door.

The flowcharts 1 and 2 include an operation control against an emergency case, which is different from the normal operation in the opening or closing operation as mentioned above. The operation in case that the back door 2 cannot be closed due to an obstacle A pinched between the back door 2 and the vehicle body 1 as shown in FIG. 9A is explained in the following as an example. In such a case, the process branches to F automatically in the flowchart 2 since the fully closed operation is not completed within a predetermined time. The back door 2 is caused to reverse in opening direction and thus the dangerous situation such as pinching of the obstacle is prevented. In this case, the driving pin 78 engages with the hook 32 for performing the opening operation, which is different from the normal operation of the flowchart 1 in which the driving pin 78 engages with the hook 31 for opening the back door 2. When the driving pin 78 reaches the vicinity of the fully open position of the back door 2, the full-open position detecting switch 95 turns to ON status and also the neutral position detecting switch 91 is maintained in ON status. The driving pin 78 further rotates in a direction in which the back door 2 opens, i.e. in the counterclockwise direction in FIG. 5. The neutral position detecting switch is turned to OFF status from ON status when the driving pin 78 slightly passes over the highest position thereof. The electric motor 61 stops driving when the switching of the neutral position detecting switch 91 is detected and then the operation of the back door 2 is completed when a state shown in FIG. 5A is obtained.

According to the flowchart 2, the process is shifted to the flowchart 1 from F in the same way as a case where the fully closed operation is not completed within the aforementioned predetermined time when the operation switch is operated during the closing operation of the back door 2. The operation that avoids the dangerous situation of the back door 2 can be achieved.

Whereas, according to the flowchart 1, the operation that avoids the dangerous situation such as pinching of the obstacle in the back door 2 can be achieved by the process branching to E in the flowchart 1. This operation is performed just in the opposite manner to the flowchart 2 and thus the detailed explanation is omitted.

The driving pin 78 does not engage with either the hook 31 or the hook 32 when the back door 2 is in the fully open or fully closed position. At this time, thus, the manual operation of the back door 2 is possible in the same way as the known back door that is not equipped with the driving unit 10.

According to the aforementioned embodiment, the driving pin 78 engages with the hook 31 or 32 so that the driving pin 78 rotates with the driving arm 5 as a unit during the opening or closing operation of the back door 2. Therefore, the opening or closing operation of the back door 2 can be stopped through the one-touch operation to initiate reversing. In addition, the back door 2 can be automatically reversed, thereby avoiding the dangerous situation such as pinching of the obstacle between the back door 2 and the vehicle body 1.

According to the aforementioned embodiment, in addition, a simple parts structure and a secure engagement mechanism can be achieved by employing the driving pin 78 to be in contact with the driving arm 5 when the driving pin 78 rotates in one direction and engages with one of the hooks 31 and 32 by means of the arc wall 85.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

What is claimed is:

1. A door driving unit comprising:

a driving mechanism rotatable in a reciprocating manner within a predetermined operational angle range;

a body portion fixed to a vehicle body;

a first member driven by the driving mechanism;

a second member driven by the first member by being in contact with the first member; the first member and the second member being supported by a common shaft; and an engaging mechanism for engaging the first member and the second member with each other so that the first member and the second member rotate as a unit with each other within a first predetermined angle range when the first member drives the second member;

wherein the first member includes at least one contacting portion which comes in contact with the second member when the first member rotates in one direction and the contacting portion comprises part of the engaging mechanism;

wherein the second member includes a driving arm having a flange portion formed at an outer peripheral portion of the driving arm, an arc portion formed at an edge portion of the flange portion along a second predetermined angle range with respect to the common shaft, and a pair of shoulder portions formed at both ends of the arc portion respectively and extending outwardly in a radial direction of the arc portion; and wherein the engaging mechanism includes a pair of hooks, each of which is assembled to the flange portion adjacent a respective one of the shoulder portions via a shaft and engages with a respective contacting wall of the body portion for engaging the at least one contacting portion to engage the first and second members.

2. The door driving unit according to claim 1, wherein the first member comprises an output gear that is arranged within a space defined in the body portion.

3. The door driving unit according to claim 2, wherein the contacting portion includes a driving pin provided on a side face of the output gear so as to project therefrom at a right angle.

4. The door driving unit according to claim 3, further comprising: a cam plate fixed to the output gear, and a neutral position detecting switch fixed to the body portion via a bracket for detecting a position of the driving pin.

5. The Deer door driving unit according to claim 4, wherein the cam plate switches the neutral position detecting switch between ON status and OFF status when the driving pin rotates to reach an end position thereof.

6. The door driving unit according to claim 1, wherein the contacting walls include two arc walls positioned radially outwardly from the respective hooks with respect to the common shaft.

* * * * *